US009986334B2

(12) United States Patent
Ren et al.

(10) Patent No.: US 9,986,334 B2
(45) Date of Patent: May 29, 2018

(54) BONE-CONDUCTION SOUND TRANSMISSION DEVICE AND METHOD

(71) Applicant: BOE TECHNOLOGY GROUP CO., LTD., Beijing (CN)

(72) Inventors: Junyuan Ren, Beijing (CN); Jinglu Bai, Beijing (CN); Xuewen LV, Beijing (CN)

(73) Assignee: BOE TECHNOLOGY GROUP CO., LTD, Beijing (CN)

( * ) Notice: Subject to any disclaimer, the term of this patent is extended or adjusted under 35 U.S.C. 154(b) by 0 days. days.

(21) Appl. No.: 15/037,643

(22) PCT Filed: Oct. 23, 2015

(86) PCT No.: PCT/CN2015/092672
§ 371 (c)(1),
(2) Date: May 18, 2016

(87) PCT Pub. No.: WO2016/192277
PCT Pub. Date: Dec. 8, 2016

(65) Prior Publication Data

US 2017/0127183 A1 May 4, 2017

(30) Foreign Application Priority Data

May 29, 2015 (CN) ..... 2015 1 0290409

(51) Int. Cl.
*H04R 3/04* (2006.01)

(52) U.S. Cl.
CPC ..... *H04R 3/04* (2013.01); *H04R 2430/03* (2013.01)

(58) Field of Classification Search
CPC ..... H04R 1/46; H04R 3/04; H04R 2430/03; H04M 1/05
See application file for complete search history.

(56) References Cited

U.S. PATENT DOCUMENTS

2005/0141730 A1* 6/2005 Murphy ..... H04M 1/05 381/74
2007/0156011 A1 7/2007 Westerkull
(Continued)

FOREIGN PATENT DOCUMENTS

CN 101536549 9/2009
CN 102421050 4/2012
(Continued)

OTHER PUBLICATIONS

International Search Report and Written Opinion with English Language Translation, dated Mar. 3, 2016, Application No. PCT/CN2015/092672.
(Continued)

*Primary Examiner* — Fan Tsang
*Assistant Examiner* — Angelica M McKinney
(74) *Attorney, Agent, or Firm* — Womble Bond Dickinson (US) LLP

(57) ABSTRACT

Embodiments of the invention disclose a bone-conduction sound transmission device and method. The device comprises a signal output module for providing a digital audio signal, a signal conversion and emission module for converting the digital audio signal into a vibration signal and emitting the vibration signal, a signal detection module, for detecting the vibration signal for at least one position in the transmission path from the signal conversion and emission module to a receiving end, and a signal feedback module which is configured to calculate an attenuation coefficient of the vibration signal at each of the positions, determine a compensation signal based on the attenuation coefficient and compensate for the vibration signal generated from the signal conversion and emission module with the compensation signal.

18 Claims, 6 Drawing Sheets

(56) References Cited

U.S. PATENT DOCUMENTS

| | | | | |
|---|---|---|---|---|
| 2009/0304210 | A1 | 12/2009 | Weisman | |
| 2014/0363033 | A1 * | 12/2014 | Heiman | H04R 1/46<br>381/151 |

FOREIGN PATENT DOCUMENTS

| | | | |
|---|---|---|---|
| CN | 203039850 | U | 7/2013 |
| CN | 104936096 | | 9/2015 |
| CN | 204721589 | | 10/2015 |
| EP | 2011367 | * | 1/2009 |
| WO | WO-2009134107 | | 11/2009 |

OTHER PUBLICATIONS

Office Action in Chinese Application No. 201510290409.6 dated Aug. 3, 2017, with English translation.

* cited by examiner

BONE-CONDUCTION SOUND TRANSMISSION DEVICE AND METHOD

RELATED APPLICATIONS

The present application is the U.S. national phase entry of PCT/CN2015/092672, with an international filing date of Oct. 23, 2015, which claims the benefit of Chinese Patent Application NO. 201510290409.6, filed on May 29, 2015, the entire disclosure of which is incorporated herein by reference.

TECHNICAL FIELD

The invention relates to the field of bone-conduction technology, in particular to a bone-conduction sound transmission device and bone-conduction sound transmission method.

BACKGROUND

As a way of transmitting sound, bone-conduction achieves sound transmission by converting a sound signal into mechanical vibration signals of different frequencies, and sound waves being transmitted through the skull, the bony labyrinth, the endolymphe, the spiral organ, the auditory nerve, and the auditory center of a human. Compared to the classic sound transmission manner of generating sound waves by the eardrum, bone-conduction omits many steps of transmitting sound waves, also, sound can be reproduced clearly in a noisy environment, and the sound waves will not affect other persons due to sound diffusion in the air.

Although there are sound transmission devices using bone-conduction at present, the listening effect is greatly affected, since the sound transmitted by the conventional bone-conduction sound transmission devices will suffer from attenuation when passing through mediums such as the skin, soft tissue and skeleton of human body, which may result in a rather larger sound distortion between the sound heard by a user and the sound that reaches the user through air conduction.

SUMMARY

An objective of the invention is to provide a bone-conduction sound transmission device and a bone-conduction sound transmission method, so as to mitigate or alleviate the problem of the larger sound distortion during the process of bone-conduction for the existing bone-conduction sound transmission device.

In one aspect, an embodiment of the invention provides a bone-conduction sound transmission device, which may comprise a signal output module for providing a digital audio signal, a signal conversion and emission module, for converting the digital audio signal into a vibration signal and emitting the vibration signal, a signal detection module, for detecting the vibration signal for at least one position in the transmission path from the signal conversion and emission module to a receiving end, and a signal feedback module which is configured to calculate an attenuation coefficient of the vibration signal at each of the positions, determine a compensation signal based on the attenuation coefficient and compensate for the vibration signal generated from the signal conversion and emission module with the compensation signal.

In some embodiments, the signal conversion and emission module may comprise a vibration generation component for emitting the vibration signal, and the signal feedback module may apply the compensation signal to the vibration generation component.

In some embodiments, the signal detection module may comprise a signal amplitude detection unit for detecting an amplitude of the vibration signal for at least one position in the transmission path from the signal conversion and emission module to the receiving end, the compensation signal may comprise an amplitude compensation signal, the signal feedback module may be configured to calculate an amplitude attenuation coefficient of the vibration signal at each of the positions, and determine the amplitude compensation signal based on the amplitude attenuation coefficient.

In some embodiments, the signal amplitude detection unit may comprise at least one signal amplitude detection component corresponding to the position to be detected, which may be configured to detect the amplitude of the vibration signal transmitted to the corresponding position.

In some embodiments, the signal feedback module may calculate the amplitude attenuation coefficient for the vibration signal at each of the positions according to the following equation (1), $$\alpha_i=(U_0-U_i)/U_0 \tag{1}$$

$\alpha_i$ denotes the amplitude attenuation coefficient of the vibration signal transmitted to the i-th position, and i is a positive integer, the maximum value of which corresponds to the number of the positions. $U_0$ denotes an initial amplitude of the vibration signal emitted from the signal conversion and emission module, and $U_i$ denotes the amplitude of the vibration signal transmitted to the i-th position. The signal feedback module may further determine the amplitude compensation signal for each position according to the following equation (2), $$B_i=f(\alpha_i) \tag{2}$$

$B_i$ denotes the amplitude compensation signal for the i-th position, $f(\alpha_i)$ may be a piecewise function, so that $B_i$ may be in the form of a pulse signal, the value of which is more than one times as large as that of $\alpha_i$.

In some embodiments, the number of the positions is N, each position may be provided with a signal amplitude detection component for detecting the amplitude of the vibration signal transmitted to this position.

In some embodiments, among the N positions, a distance between the j-th position and the signal conversion and emission module may be greater than a distance between the (j−1)-th position and the signal conversion and emission module, j is a positive integer, and $1<j\leq N$. The signal feedback module may calculate the amplitude attenuation coefficient for the vibration signal at each position according to the following equation (3), $$\alpha_j=(U_{j-1}-U_j)/U_{j-1} \tag{3}$$

$\alpha_j$ denotes the amplitude attenuation coefficient of the vibration signal transmitted to the j-th position, $U_j$ denotes the amplitude of the vibration signal transmitted to the j-th position, an initial amplitude of the vibration signal emitted from the signal conversion and emission module is $U_0$ in case of j=1. The signal feedback module may further determine the amplitude compensation signal for each position according to the following equation (4), $$B_j=f(\alpha_j) \tag{4}$$

$B_j$ denotes the amplitude compensation signal for the j-th position, $f(\alpha_j)$ may be a piecewise function, so that $B_j$ may be in the form of a pulse signal, the value of which is more than one times as large as that of $\alpha_j$.

In some embodiments, the signal conversion and emission module may further comprise a first frequency division unit configured to perform frequency division for the digital audio signal such that the digital audio signal is divided into M sub-audio signals having different frequency bands, each sub-audio signal having a center frequency of $f_k$, and M being a positive integer, k being a positive integer in the range of 1 to M, a multi-frequency signal conversion unit configured to convert the M sub-audio signals having different frequency bands and the center frequency of $f_k$ into M sub vibration signals, and a mixing unit for combining the M sub vibration signals into a complete vibration signal.

In some embodiments, the signal conversion and emission module may further comprise a first filtering unit for filtering the digital audio signal, and the first frequency division unit may be configured to perform frequency division for the filtered digital audio signal.

In some embodiments, the signal feedback module may further comprise a second frequency division unit, which may be configured to perform frequency division for the vibration signal detected by the signal detection module, so that the detected vibration signal is divided into M sub-detected vibration signals having different frequency bands in consistent with those of the divided digital audio signals, each sub-detected vibration signal having the center frequency of $f_k$, M being a positive integer, k being a positive integer in the range of 1 to M; and a multiple-frequency signal feedback unit, which may be configured to calculate the attenuation coefficient for each of the M sub-detected vibration signals having the center frequency of $f_k$, determine M compensation signals based on the calculated M attenuation coefficients, and compensate for the M sub vibration signals generated by the multi-frequency signal conversion unit with the M compensation signals.

In some embodiments, the signal feedback module may further comprise a second filtering unit for filtering the vibration signal detected by the signal detection module, and the second frequency division unit may be configured to perform frequency division for the filtered vibration signal.

In some embodiments, the signal output module may comprise an environmental audio receiving unit for receiving an environmental audio signal and converting the environmental audio signal into the digital audio signal.

As a second aspect, another embodiment of the invention provides a bone-conduction sound transmission method, which may comprise the steps of providing a digital audio signal, converting the digital audio signal into a vibration signal and emitting the vibration signal, detecting the vibration signal for at least one position in a transmission path from an emission end to a receiving end, calculating an attenuation coefficient of the vibration signal at each of the positions, determining a compensation signal based on the attenuation coefficient, and compensating for the vibration signal with the compensation signal.

In some embodiments, the step of detecting the vibration signal for at least one position in a transmission path from an emission end to a receiving end may comprise detecting the amplitude of the vibration signal for at least one position in the transmission path from the emission end to the receiving end. The step of calculating an attenuation coefficient of the vibration signal at each of the positions may comprise calculating an amplitude attenuation coefficient of the vibration signal at each of the positions. The compensation signal may comprise an amplitude compensation signal, the step of determining a compensation signal based on the attenuation coefficient may comprise determining the amplitude compensation signal based on the amplitude attenuation coefficient.

In some embodiments, the step of calculating an amplitude attenuation coefficient of the vibration signal at each of the positions may comprise calculating the amplitude attenuation coefficient for the vibration signal at each position according to the following equation (1), $$\alpha_i=(U_0-U_i)/U_0 \tag{1}$$

$\alpha_i$ denotes the amplitude attenuation coefficient of the vibration signal transmitted to the i-th position, and i is a positive integer, the maximum value of which corresponds to the number of the positions. $U_0$ denotes an initial amplitude of the vibration signal emitted from the emission end, and $U_i$ denotes the amplitude of the vibration signal transmitted to the i-th position. The step of determining the amplitude compensation signal based on the amplitude attenuation coefficient may comprise determining the amplitude compensation signal for each position according to the following equation (2), $$B_i=f(\alpha_i) \tag{2}$$

$B_i$ denotes the amplitude compensation signal for the i-th position, $f(\alpha_i)$ may be a piecewise function, so that $B_i$ may be in the form of a pulse signal, the value of which is more than one times as large as that of $\alpha_i$.

In some embodiments, the number of the positions is N, among the N positions, a distance between the j-th position and the emission end may be greater than a distance between the (j−1)-th position and the emission end, j is a positive integer, and $1<j\leq N$. The step of calculating an amplitude attenuation coefficient of the vibration signal at each of the positions may comprise calculating the amplitude attenuation coefficient for the vibration signal at each position according to the following equation (3), $$\alpha_j=(U_{j-1}-U_j)/U_{j-1} \tag{3}$$

$\alpha_j$ denotes the amplitude attenuation coefficient of the vibration signal transmitted to the j-th position, $U_j$ denotes the amplitude of the vibration signal transmitted to the j-th position in case of j>1, an initial amplitude of the vibration signal emitted from the emission end is $U_0$ in case of j=1. The step of determining the amplitude compensation signal based on the amplitude attenuation coefficient may comprise determining the amplitude compensation signal for each position according to the following equation (4), $$B_j=f(\alpha_j) \tag{4}$$

$B_j$ denotes the amplitude compensation signal for the j-th position, $f(\alpha_j)$ may be a piecewise function, so that $B_j$ may be in the form of a pulse signal, the value of which is more than one times as large as that of $\alpha_j$.

In some embodiments, the step of converting the digital audio signal into a vibration signal may comprise performing frequency division for the digital audio signal such that the digital audio signal is divided into M sub-audio signals having different frequency bands, each sub-audio signal having a center frequency of $f_k$, and M being a positive integer, k being a positive integer in the range of 1 to M; converting the M sub-audio signals having different frequency bands and the center frequency of $f_k$ into M sub vibration signals, and combining the M sub vibration signals into a complete vibration signal.

In some embodiments, the method may further comprise filtering the digital audio signal before performing frequency division for the digital audio signal.

In some embodiments, the method may further comprise before calculating the attenuation coefficient of the vibration signal at each of the positions, performing frequency division for the detected vibration signal, so that the detected vibration signal is divided into M sub-detected vibration signals having different frequency bands in consistent with those of the divided digital audio signal, each sub-detected vibration signal having the center frequency of $f_k$, M being a positive integer, k being a positive integer in the range of 1 to M. The method may further comprise after performing frequency division for the detected vibration signal, calculating the attenuation coefficient for each of the M sub-detected vibration signals having the center frequency of $f_k$, so as to determine M compensation signals based on the calculated M attenuation coefficients, and compensate for the M sub vibration signals with the M compensation signals.

In some embodiments, the method may further comprise filtering the detected vibration signal prior to performing frequency division for the detected vibration signal.

In some embodiments, the step of providing a digital audio signal may comprise receiving an environmental audio signal and converting the environmental audio signal into the digital audio signal.

With the bone-conduction sound transmission device and method provided by the embodiments of the invention, the attenuation of the sound signal in the process of bone-conduction may be compensated precisely, thus the amplitude-frequency response of the sound signal may be enhanced, and distortion of the sound signal during bone-conduction may be improved, therefore a sound of better quality can be provided for the user.

BRIEF DESCRIPTION OF THE DRAWINGS

The drawings are intended to provide a further understanding for the embodiments of the invention, and constitute a part of the specification. And they are used for explaining the invention in connection with the following specific embodiments, which will not limit the scope of the invention.

In the following description and figures, some reference signs as follows may be used:

1—signal output module 11—environmental audio receiving unit

2—signal conversion and emission module 21—first filtering unit

22—first frequency division unit

23—multi-frequency signal conversion unit

24—mixing unit 3—signal detection module

31—signal amplitude detection unit

311—first signal amplitude detection component

312—second signal amplitude detection component

313—third signal amplitude detection component

4—signal feedback module 41—second filtering unit

42—second frequency division unit

43—multiple-frequency signal feedback unit 5—receiving end

DETAILED DESCRIPTION OF EMBODIMENTS

Next, specific embodiments of the invention will be described in detail in connection with the attached drawings. It should be understood that, the embodiments described herein are just intended to explain and illustrate the invention, rather than limiting the scope of the invention.

Figure 1:
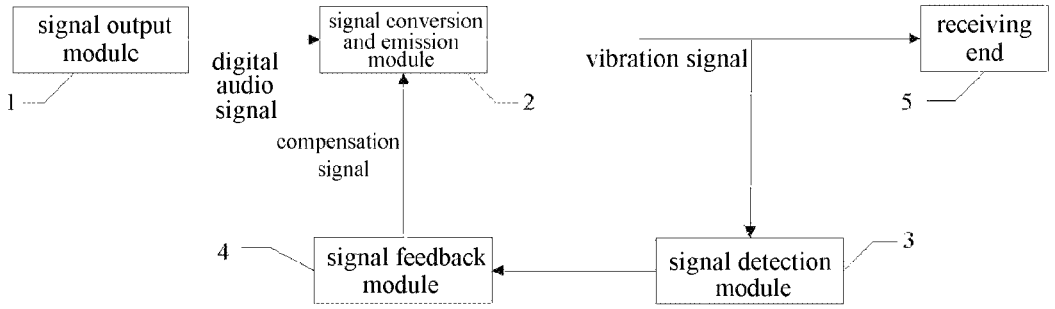
FIG. 1 is a schematic diagram of a bone-conduction sound transmission device provided by an embodiment of the invention.

An embodiment of the invention provides a bone-conduction sound transmission device. Referring to FIG. 1, the bone-conduction sound transmission device may comprise a signal output module 1 for providing a digital audio signal, a signal conversion and emission module 2 for converting the digital audio signal into a vibration signal and emitting the vibration signal, a signal detection module 3 for detecting the vibration signal for at least one position in the transmission path from the signal conversion and emission module 2 to a receiving end 5, and a signal feedback module 4 which may be configured to calculate an attenuation coefficient of the vibration signal at each of the positions, determine a compensation signal based on the attenuation coefficient and compensate for the vibration signal generated from the signal conversion and emission module with the compensation signal.

When the bone-conduction sound transmission device provided by this embodiment is in operation, the signal conversion and emission module 2 may receive the digital audio signal from the signal output module 1, and then convert this digital audio signal into the vibration signal. In an embodiment, the signal output module 1 may comprise a digital audio signal generator. The signal conversion and emission module 2 may comprise a bone-conduction vibrator and a driving chip for driving the bone-conduction vibrator. Therefore, the digital audio signal can be delivered to the driving chip, enabling the driving chip to drive the bone-conduction vibrator such that the vibration can be created, the vibration then may be transmitted through the skeleton and skin of a user.

Taking a bone-conduction headset as an example, if the signal conversion and emission module 2 is an earbud, the receiving end 5 is the user, the transmission path may comprise skeletons such as the skull transmitting the vibration signal, and said position may be any point on the skeletons acting as the transmission path.

It can be appreciated that implementations of the bone-conduction sound transmission device is not limited to this, and they can be in the form of other structures, which will not be described in detail herein.

By calculating the attenuation coefficients of the vibration signal at respective positions, the embodiment of the invention may compensate for the attenuation of sound signal in the process of bone conduction transmission, thus the distortion of sound signal during the bone conduction transmission can be improved, so that a sound having a better quality can be provided for the user at the receiving end 5.

The signal conversion and emission module 2 typically may comprise a vibration generation component for emitting the vibration signal. The signal feedback module 4 may apply the compensation signal to the vibration generation component so as to compensate for the emitted vibration signal. The vibration generation component may for example be a component having a function similar to the diaphragm in the headset or the eardrum in the human ear. And specific implementations of the vibration generation component are not limited to these.

It can be understood that, the compensation signal may be in the form of a vibration signal for compensation. Alternatively, it can be an electrical signal converted from the vibration signal detected at respective positions. The compensation signal in the form of electrical signal may be sent to the signal conversion and emission module 2 by way of a wire, then the signal conversion and emission module 2 may adjust the amplitude of the emitted vibration signal based on the compensation signal in the form of electrical signal, thereby the distortion of vibration signal can be improved during its transmission.

Figure 2:
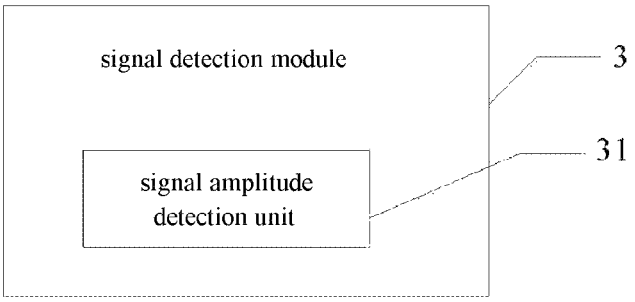
FIG. 2 is a schematic diagram of a signal detection module provided by an embodiment of the invention.

In an embodiment, as shown in FIG. 2, the signal detection module 3 may comprise a signal amplitude detection unit 31 for detecting an amplitude of the vibration signal for at least one position in the transmission path from the signal conversion and emission module 2 to the receiving end 5, the compensation signal may comprise an amplitude compensation signal, the signal feedback module 4 may be configured to calculate an amplitude attenuation coefficient of the vibration signal at each of the positions, and determine the amplitude compensation signal based on the amplitude attenuation coefficient.

By compensating for the amplitude of the vibration signal using this embodiment, the amplitude-frequency response property of the vibration signal can be improved effectively, such that the user at the receiving end 5 may receive an acoustic signal having a better sound quality.

Figure 3:
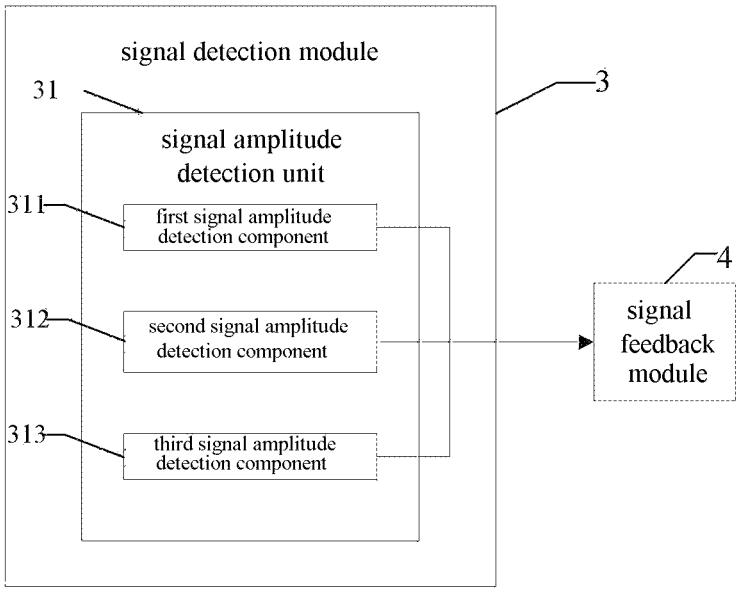
FIG. 3 is a schematic diagram of a signal detection module provided by another embodiment of the invention.

As shown in FIG. 3, in an embodiment, the signal amplitude detection unit 31 may comprise at least one signal amplitude detection component corresponding to the position to be detected, which may be configured to detect the amplitude of the vibration signal transmitted to the corresponding position.

For example, as shown in FIG. 3, the signal amplitude detection unit 31 comprises a first signal amplitude detection component 311 at a first position, a second signal amplitude detection component 312 at a second position, and a third signal amplitude detection component 313 at a third position. The first signal amplitude detection component 311, the second signal amplitude detection component 312, and the third signal amplitude detection component 313 may be used to detect amplitudes of the vibration signals transmitted to the first position, the second position and the third position, respectively.

Each of the first signal amplitude detection component 311, the second signal amplitude detection component 312, and the third signal amplitude detection component 313 is connected to the signal feedback module 4, so that the detected amplitudes of the vibration signals at the first position, the second position and the third position can be delivered to the signal feedback module 4. Then the signal feedback module 4 may determine the amplitude attenuation coefficients of the vibration signals transmitted to respective positions based on the received amplitudes of the vibration signals for respective positions, and generate corresponding amplitude compensation signals based on the amplitude attenuation coefficients.

In an embodiment of the invention, the signal feedback module 4 may the amplitude attenuation coefficient for the vibration signal at each of the positions according to the following equation (1), $$\alpha_i=(U_0-U_i)/U_0 \tag{1}$$

wherein $\alpha_i$ denotes the amplitude attenuation coefficient of the vibration signal transmitted to the i-th position, and i is a positive integer, the maximum value of which corresponds to the number of the positions. $U_0$ denotes an initial amplitude of the vibration signal emitted from the signal conversion and emission module, and $U_i$ denotes the amplitude of the vibration signal transmitted to the i-th position. The signal feedback module 4 may further determine the amplitude compensation signal for each position according to the following equation (2), $$B_i=f(\alpha_i) \tag{2}$$

wherein $B_i$ denotes the amplitude compensation signal for the i-th position, $f(\alpha_i)$ may be a piecewise function, so that $B_i$ may be in the form of a pulse signal, the value of which is more than one times as large as that of $\alpha_i$. For example, $B_i$ may be a non-linear function that depends on $\alpha_i$, for $\alpha_i$ having a relatively small value, $B_i$ may be N1 times $\alpha_i$, while for $\alpha_i$ having a relatively large value, $B_i$ may be N2 times $\alpha_i$, and N1 may be greater than N2.

In an embodiment, by comparing the amplitude $U_i$ for each position with the initial amplitude $U_0$ of the vibration signal, the amplitude attenuation coefficient $\alpha_i$ for each position and thus the amplitude compensation signal $B_i$ for each position may be obtained.

In another embodiment of the invention, the number of the positions may be N, each position may be provided with a signal amplitude detection component for detecting the amplitude of the vibration signal transmitted to this position. In other words, the signal amplitude detection unit 31 may comprise N signal amplitude detection components.

Among the N positions, the distance between the j-th position and the signal conversion and emission module 2 may be greater than the distance between the (j−1)-th position and the signal conversion and emission module 2, j is a positive integer, and $1<j\leq N$.

In this embodiment, the signal feedback module 4 may calculate the amplitude attenuation coefficient for the vibration signal at each position according to the following equation (3), $$\alpha_j=(U_{j-1}-U_j)/U_{j-1} \tag{3}$$

wherein $\alpha_j$ denotes the amplitude attenuation coefficient of the vibration signal transmitted to the j-th position, $U_j$ denotes the amplitude of the vibration signal transmitted to the j-th position, an initial amplitude of the vibration signal emitted from the signal conversion and emission module is $U_0$ in case of j=1. The signal feedback module may further determine the amplitude compensation signal for each position according to the following equation (4), $$B_j=f(\alpha_j) \tag{4}$$

wherein $B_j$ denotes the amplitude compensation signal for the j-th position, $f(\alpha_j)$ may be a piecewise function, so that $B_j$ is in the form of a pulse signal, the value of which is more than one times as large as that of $\alpha_j$.

In this embodiment, the amplitude $U_j$ for each position is compared to the amplitude $U_{j-1}$ for the preceding position.

In this way, the transmission path will be divided on a smaller, more intimate scale, the length of each sub-transmission path will be shorter, a better compensation effect therefore may be reached with such embodiment.

Taking the embodiment shown in FIG. 3 as an example, assuming that it is required to detect the vibration signals at three positions which may be distributed on the skull of the human body (generally, the more the positions is, the higher the precision will be). The first position is provided the first signal amplitude detection component 311, the second position is provided with the second signal amplitude detection component 312, the third position is provided with the third signal amplitude detection component 313. The distances from the signal conversion and emission module 2 to the first signal amplitude detection component 311, the second signal amplitude detection component 312 and the third signal amplitude detection component 313 are respectively denoted as $L_1$, $L_2$ and $L_3$.

Figure 4:
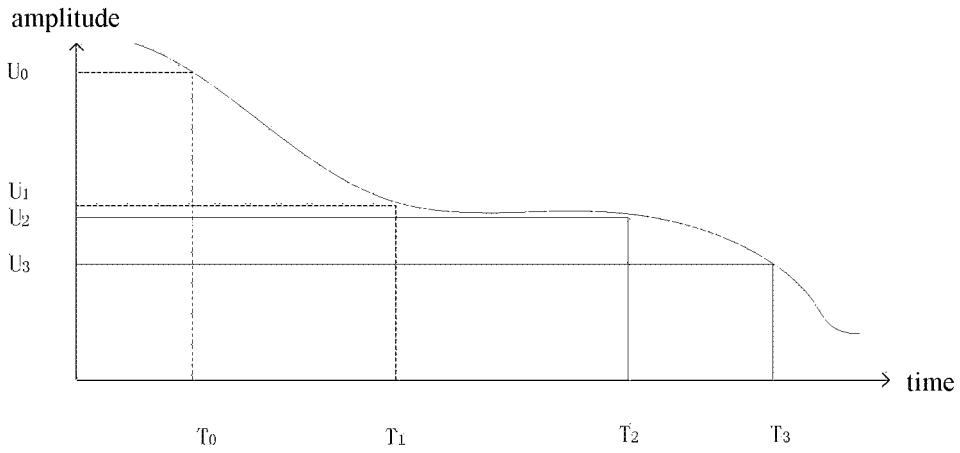
FIG. 4 illustrates the attenuation in the amplitude of the vibration signal over time.

Referring to FIG. 4, the time when the vibration signal is emitted from the signal conversion and emission module 2 is denoted as $T_0$, and $T_1$、$T_2$、$T_3$ respectively denotes the times at which the vibration signal reaches the first signal amplitude detection component 311, the second signal amplitude detection component 312 and the third signal amplitude detection component 313. If the time period for the complete transmission path of the vibration signal from the signal conversion and emission module 2 to the ear of the human is denoted as one cycle T, then each of $T_1$、$T_2$、$T_3$ is comprised in the time period of $T_0$ to T.

Figure 5:
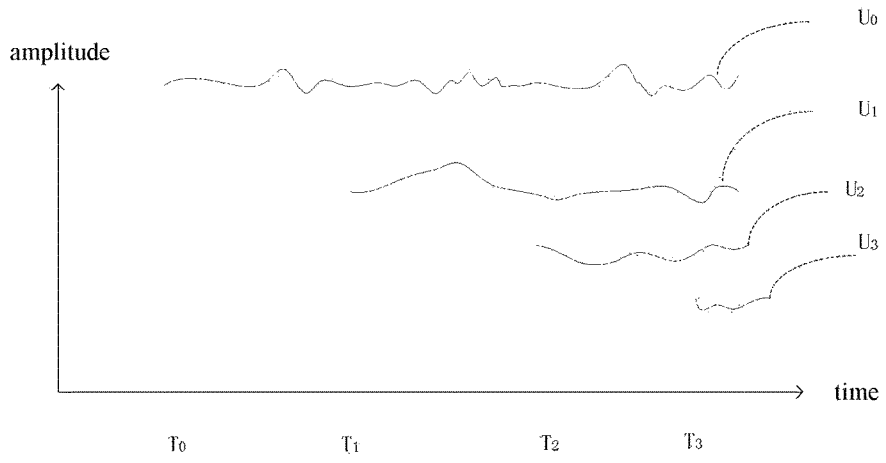
FIG. 5 illustrates the amplitude variation of the vibration signal over time before compensation.

$U_0$ denotes the initial amplitude of the vibration signal emitted from the signal conversion and emission module 2, amplitudes of the vibration signals at the first position, second position and third position respectively detected by the first signal amplitude detection component 311, the second signal amplitude detection component 312 and the third signal amplitude detection component 313 are denoted as $U_1$、$U_2$、$U_3$, respectively. FIG. 5 illustrates the curves of $U_0$、$U_1$、$U_2$、$U_3$ over time before compensation.

The signal feedback module 4 may respectively calculate a first amplitude attenuation coefficient of the vibration signal transmitted to the first position after emitted from the signal conversion and emission module 2, a second amplitude attenuation coefficient of the vibration signal transmitted from the first position to the second position, and a third amplitude attenuation coefficient of the vibration signal transmitted from the second position to the third position according to the following equations (5), (6) and (7):

$$\alpha_1=(U_0-U_1)/U_0 \tag{5}$$

$$\alpha_2=(U_1-U_2)/U_1 \tag{6}$$

$$\alpha_3=(U_2-U_3)/U_2 \tag{7}$$

$\alpha_1$ denotes the first amplitude attenuation coefficient, $\alpha_2$ denotes the second amplitude attenuation coefficient, and $\alpha_3$ denotes the third amplitude attenuation coefficient. $U_0$ denotes the initial amplitude of the vibration signal emitted from the signal conversion and emission module 2, $U_1$ denotes the amplitude of the vibration signal transmitted to the first position, $U_2$ denotes the amplitude of the vibration signal transmitted to the second position, $U_3$ denotes the amplitude of the vibration signal transmitted to the third position.

Moreover, the signal feedback module 4 may determine a first amplitude compensation signal, a second amplitude compensation signal, and a third amplitude compensation signal that respectively correspond to the first position, second position and third position according the following equations (8), (9) and (10):

$$B_1=f(\alpha_1) \tag{8}$$

$$B_2=f(\alpha_2) \tag{9}$$

$$B_3=f(\alpha_3) \tag{10}$$

$B_1$ denotes the first amplitude compensation signal, and may be a pulse signal, the value of which is more than one times as large as that of $\alpha_1$. $B_2$ denotes the second amplitude compensation signal, and may be a pulse signal, the value of which is more than one times as large as that of $\alpha_2$. $B_3$ denotes the third amplitude compensation signal, and may be a pulse signal, the value of which is more than one times as large as that of $\alpha_3$. The pulse signals may be generated by a conventional amplifier element such as a proportional amplifier.

Figure 6:
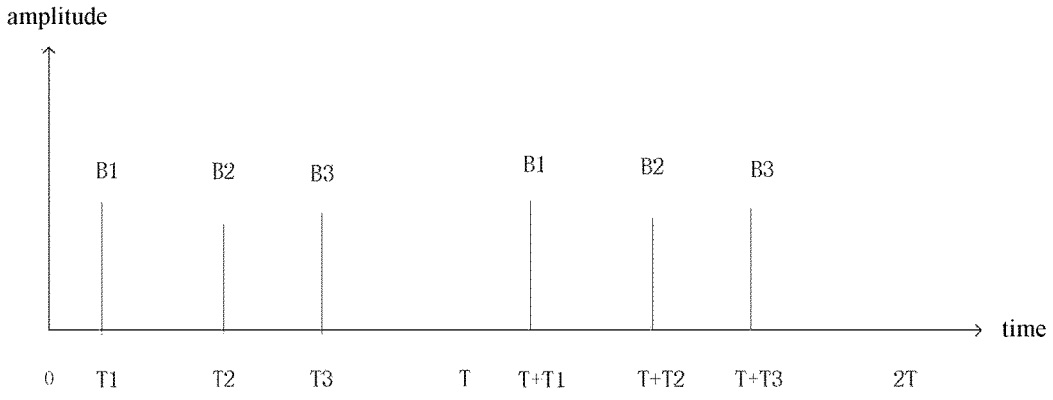
FIG. 6 illustrates the provided compensation signal in an embodiment of the invention.

As shown in FIG. 6, the first amplitude compensation signal $B_1$ may be provided approximately at the time of $T_1$, the second amplitude compensation signal $B_2$ may be provided after the time interval of $T_2$-$T_1$, and the third amplitude compensation signal $B_3$ may be provided after the time interval of $T_3$-$T_2$, so as to compensate for the signal attenuation at respective positions accurately. The signal feedback module 4 may provide the above compensation pulse signals $B_1$, $B_2$ and $B_3$ on a cycle of T.

Figure 7:
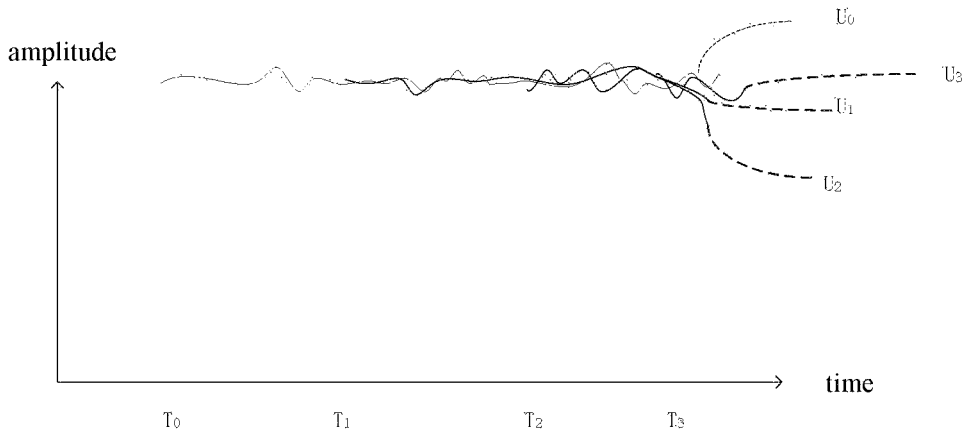
FIG. 7 illustrates the amplitude variation of the vibration signal over time after compensation.

FIG. 7 illustrates curves of $U_1$, $U_2$ and $U_3$ over time after compensation. It can be seen that, each of the amplitudes of the vibration signals $U_1$, $U_2$ and $U_3$ after compensation detected by the first signal amplitude detection component 311, the second signal amplitude detection component 312 and the third signal amplitude detection component 313 may be substantially kept at the level of $U_0$. Therefore, distortion of acoustical signal may be improved effectively during the process of bone-conduction.

Figure 8:
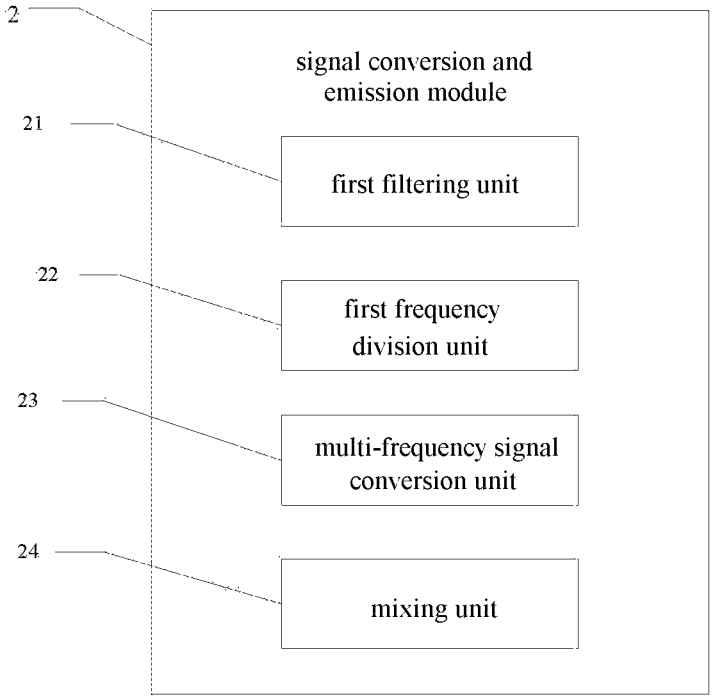
FIG. 8 is a schematic diagram of a signal conversion and emission module provided by an embodiment of the invention.

As shown in FIG. 8, the signal conversion and emission module 2 may further comprise a first frequency division unit 22 configured to perform frequency division for the digital audio signal such that the digital audio signal is divided into M sub-audio signals having different frequency bands, each sub-audio signal having a center frequency of $f_k$, and M being a positive integer, k being a positive integer in the range of 1 to M; a multi-frequency signal conversion unit 23 configured to convert the M sub-audio signals having different frequency bands and the center frequency of $f_k$ into M sub vibration signals, and a mixing unit 24 for combining the M sub vibration signals into a complete vibration signal.

When the signal conversion and emission module 2 is in operation, the first frequency division unit 22 receives the digital audio signal outputted from the signal output module 1, and performs frequency division for the digital audio signal to divide the digital audio signal into M sub-audio signals having different frequency bands. Thereafter, the first frequency division unit 22 delivers the M sub-audio signals having different frequency bands to the multi-frequency signal conversion unit 23.

After receiving the M sub-audio signals having different frequency bands, the multi-frequency signal conversion unit 23 may convert them into vibration signals, so as to obtain the M sub vibration signals to be emitted. Then, the multi-frequency signal conversion unit 23 delivers the M sub vibration signals to the mixing unit 24. Upon receiving the M sub vibration signals, the mixing unit 24 may combine the M sub vibration signals into a complete vibration signal and emit the complete vibration signal.

Figure 9:
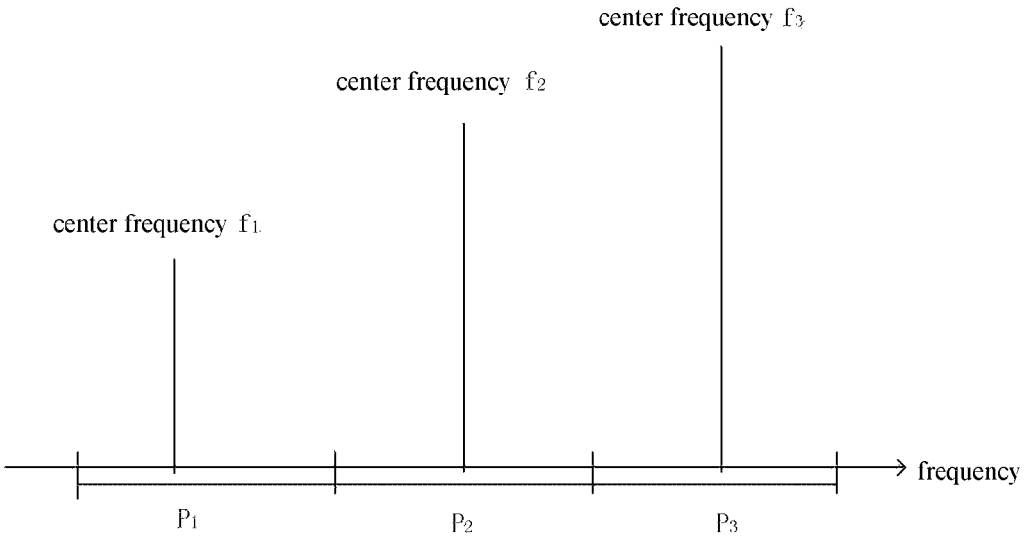
FIG. 9 illustrates the frequency division for the signals.

In the embodiment of the invention, the digital audio signal may be divided into several sub-audio signals having different frequency bands according to human auditory characteristics, then be processed and transmitted by means of the bone-conduction technology, in this way, the quality of the acoustical signal may be improved. For example, as shown in FIG. 9, the digital audio signal may be divided into three sub-audio signals having frequency bands of $P_1$, $P_2$ and $P_3$, the center frequencies of each of the three sub-audio signals are $f_1$、$f_2$、$f_3$ respectively. Generally, the more the different frequency bands are, the higher the precision will be, and the better the effect of the acoustical signal heard by the human will be.

In another embodiment, the signal conversion and emission module 2 may further comprise a first filtering unit 21 for filtering the digital audio signal to eliminate noise. The first frequency division unit 22 is configured to perform frequency division for the filtered digital audio signal.

In this case, the first filtering unit 21 may receive the digital audio signal outputted from the signal output module 1, and filter the digital audio signal. The filtered digital audio signal is delivered to the first frequency division unit 22, which then may perform frequency division for the filtered digital audio signal.

Figure 10:
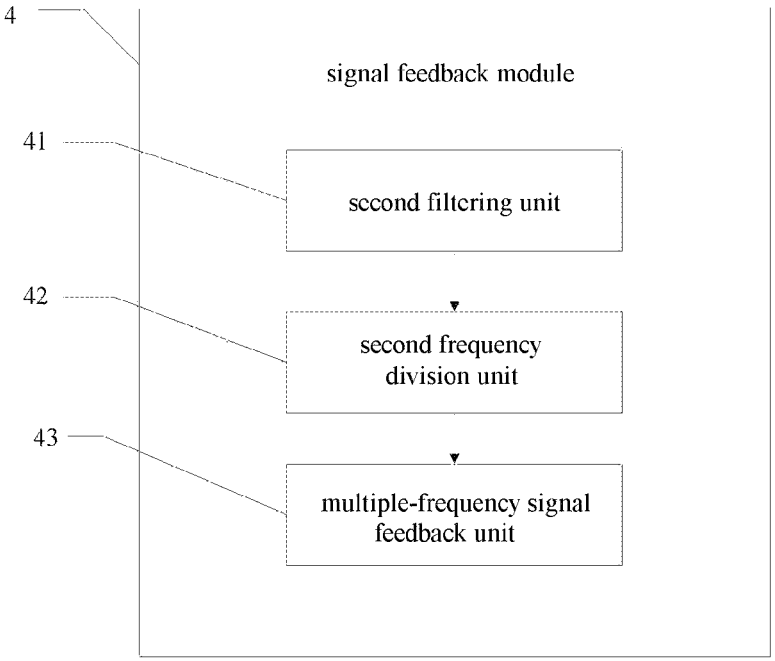
FIG. 10 is a schematic diagram of a signal feedback module provided by an embodiment of the invention.

In yet another embodiment of the invention, as shown in FIG. 10, the signal feedback module 4 may further comprise a second frequency division unit 42, which may be configured to perform frequency division for the vibration signal detected by the signal detection module 3, so that the detected vibration signal is divided into M sub-detected vibration signals having different frequency bands in consistent with those of the divided digital audio signal, each sub-detected vibration signal having the center frequency of $f_k$, M being a positive integer, k being a positive integer in the range of 1 to M. The signal feedback module 4 may further comprise a multiple-frequency signal feedback unit 43, which may be configured to calculate the attenuation coefficient for each of the M sub-detected vibration signals having the center frequency of $f_k$, determine M compensation signals based on the calculated M attenuation coefficients, and compensate for the M sub vibration signals generated by the multi-frequency signal conversion unit 23 with the M compensation signals.

In this embodiment, the signal detection module 3 may deliver the detected vibration signal to the signal feedback module 4. When the signal feedback module 4 is in operation, the second frequency division unit 42 receives the detected vibration signal, and divides it into M sub-detected vibration signals having different frequency bands in consistent with those of the divided digital audio signal, which then will be delivered to the multiple-frequency signal feedback unit 43.

After receiving the M sub-detected vibration signals, the multiple-frequency signal feedback unit 43 calculates M attenuation coefficients that correspond to the M sub-detected vibration signals, and determine M compensation signals based on the M attenuation coefficients. Then the M compensation signals may be respectively provided to the M sub vibration signals generated by the multi-frequency signal conversion unit 23, such that the sub vibration signals may be compensated and the signal distortion can be mitigated.

Taking FIG. 9 as an example, the detected vibration signal may be divided into three sub-detected vibration signals having frequency bands of P1, P2 and P3, which are in consistent with those of the divide digital audio signal. Also the center frequencies of the three sub-detected vibration signals are $f_1$、$f_2$、$f_3$ respectively, such that the frequency bands of the sub-detected vibration signals are in consistent with those of the sub vibration signals. The multiple-frequency signal feedback unit 43 calculates attenuation coefficients and compensation signals for the sub-detected vibration signals having the center frequencies of $f_1$、$f_2$、$f_3$, then the calculated three compensation signals are used to compensate for the three sub vibration signals generated by the multi-frequency signal conversion unit 23, thereby the accuracy of the compensation may be assured.

In other embodiments, the signal feedback module 4 may further comprise a second filtering unit 41 for filtering the vibration signal detected by the signal detection module 3 to eliminate noise. The second frequency division unit 42 may be configured to perform frequency division for the filtered vibration signal.

In this case, the second filtering unit 41 may receive the vibration signal detected by the signal detection module 3, and filter the detected vibration signal. The filtered vibration signal is delivered to the second frequency division unit 42, which then may perform frequency division for the filtered vibration signal.

Next, embodiments of the invention will be set forth in detail by way of an example in which the detected vibration signal is divided into three sub-detected vibration signals relating to different frequency bands and three positions is selected.

First, the first frequency division unit 22 in the signal conversion and emission module 2 performs frequency division for the digital audio signals to obtain three sub-audio signals relating to three frequency bands and having center frequencies of f1, f2, and f3. The multi-frequency signal conversion unit 23 converts the three sub-audio signals into three sub vibration signals having center frequencies of f1, f2, and f3 respectively. The mixing unit 24 combines the three sub vibration signals relating to three frequency bands into a complete vibration signal.

Then, the signal detection module 3 detects the vibration signal transmitted to the first position, second position and third position.

Thereafter, the second frequency division unit 42 of the signal feedback module 4 divides the detected vibration signal into three sub-detected vibration signals of different frequency bands respectively having center frequencies of f1, f2, and f3. The sub vibration signal corresponding to the sub-detected vibration signal having the center frequency of f1 is emitted from the signal conversion and emission module 2 at the time of $T_0$, and transmitted to the first signal amplitude detection component 311 on the first position at the time of $T_{11}$, transmitted to the second signal amplitude detection component 312 on the second position at the time of $T_{12}$, then transmitted to the third signal amplitude detection component 313 on the third position at the time of $T_{13}$. The whole transmission cycle of this sub vibration signal from the signal conversion and emission module 2 to the human's ear is a time period of T.

The initial amplitude of the sub vibration signal corresponding to the sub-detected vibration signal having the center frequency of $f_1$ emitted from the signal conversion and emission module 2 is $U_{10}$, and $U_{11}$、$U_{12}$、$U_{13}$ respectively denotes corresponding amplitudes of this signal when transmitted to the first, second and third positions.

Similarly, the initial amplitude of the sub vibration signal corresponding to the sub-detected vibration signal having the center frequency of $f_2$ emitted from the signal conversion and emission module 2 is $U_{20}$, and $U_{21}$、$U_{22}$、$U_{23}$ may respectively denote the amplitudes of this signal when transmitted to the first, second and third positions. The initial amplitude of the sub vibration signal corresponding to the sub-detected vibration signal having the center frequency of $f_3$ emitted from the signal conversion and emission module 2 is $U_{30}$, and $U_{31}$、$U_{32}$、$U_{33}$ may respectively denote the amplitudes of this signal when transmitted to the first, second and third positions.

In the following, the signal feedback module 4 may calculate amplitude attenuation coefficients $\alpha_{11}$、$\alpha_{12}$、$\alpha_{13}$ of the sub vibration signal corresponding to the sub-detected vibration signal having the center frequency of $f_1$ transmitted to the first, second and third position respectively. And $\alpha_{11}=(U_{10}-U_{11})/U_{10}$, $\alpha_{12}=(U_{11}-U_{12})/U_{11}$, $\alpha_{13}=(U_{12}-U_{11})/U_{12}$. Then, an amplitude compensation signal $B_{11}$ approximately provided at the time of $T_{11}$, an amplitude compensation signal $B_{12}$ provided after a time period of $T_{12}$-$T_{11}$, an amplitude compensation signal $B_{13}$ provided after a time period of $T_{13}$-$T_{12}$ are determined based on the calculated amplitude attenuation coefficients $\alpha_{11}$、$\alpha_{12}$、$\alpha_{13}$. $B_{11}=f(\alpha_{11})$, so that $B_{11}$ is a pulse signal, the value of which is more than one times as large as that of $\alpha_{11}$. $B_{12}=f(\alpha_{12})$, so that $B_{12}$ is a pulse signal, the value of which is more than one times as large as that of $\alpha_{12}$. $B_{13}=f(\alpha_{13})$, so that $B_{13}$ is a pulse signal, the value of which is more than one times as large as that of $\alpha_{13}$.

In embodiments of the invention, the above pulse signal for compensation may be provided by means of a conventional amplifier (e.g., a proportional amplifier), such that each of the amplitudes of the vibration signals detected by the first signal amplitude detection component 311, the second signal amplitude detection component 312 and the third signal amplitude detection component 313 is substantially $U_0$.

Similarly, the signal feedback module 4 may calculate the amplitude attenuation coefficients of the sub vibration signal corresponding to the sub-detected vibration signal having the center frequency of $f_2$ transmitted to the first, second and third position as $\alpha_{21}$、$\alpha_{22}$、$\alpha_{23}$, respectively, and the corresponding amplitude compensation signals are $B_{21}$、$B_{22}$、$B_{23}$ respectively. The amplitude attenuation coefficients of the sub vibration signal corresponding to the sub-detected vibration signal having the center frequency of $f_3$ transmitted to the first, second and third position are $\alpha_{31}$、$\alpha_{32}$、$\alpha_{33}$, respectively, and the corresponding amplitude compensation signals are $B_{31}$、$B_{32}$、$B_{33}$ respectively.

Subsequently, the signal feedback module 4 may provide the amplitude compensation signals $B_{11}$、$B_{12}$、$B_{13}$ corresponding to the frequency band with the center frequency of $f_1$, the amplitude compensation signals $B_{21}$、$B_{22}$、$B_{23}$ corresponding to the frequency band with the center frequency of $f_2$ and the amplitude compensation signals $B_{31}$、$B_{32}$、$B_{33}$ corresponding to the frequency band with the center frequency of $f_3$ on a cycle of T. The above amplitude compensation signals may be respectively used to compensate for the sub vibration signals corresponding to different frequency bands generated by the multi-frequency signal conversion unit 23 in the signal conversion and emission module 2.

Figure 11:
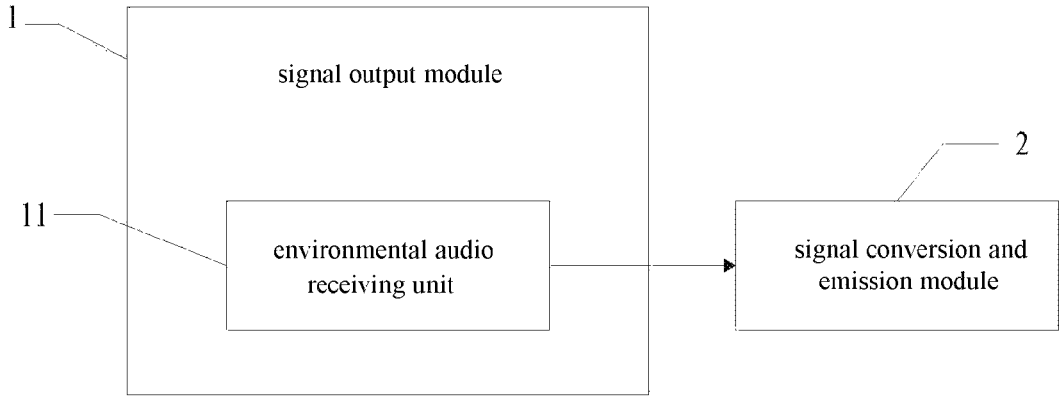
FIG. 11 is a schematic diagram of a signal output module provided by an embodiment of the invention.

In some embodiments, as shown in FIG. 11, the signal output module 1 may comprise environmental audio receiving unit 11 for receiving an environmental audio signal and converting the environmental audio signal into the digital audio signal. In this embodiment, the environmental audio receiving unit 11 may deliver the converted digital audio signal to the signal conversion and emission module 2.

Therefore, the bone-conduction sound transmission device provided by the embodiments of the invention may enhance the hearing effect of the human's ear for the environmental sound. Such device may be used in the headset, and also in the hearing-aid device. Moreover, advantages of a low distortion of the sound signal, a good amplitude-frequency response and a good quality of the sound may be achieved by the bone-conduction sound transmission device provided by the embodiments of the invention.

Another embodiment of the invention provides a bone-conduction sound transmission method. The method may comprise the following steps: providing a digital audio signal; converting the digital audio signal into a vibration signal and emitting the vibration signal; detecting the vibration signal for at least one position in a transmission path from an emission end to a receiving end; calculating an attenuation coefficient of the vibration signal at each of the positions; determining a compensation signal based on the attenuation coefficient, and compensating for the vibration signal with the compensation signal.

With this embodiment, attenuation of the sound signal during the process of bone-conduction may be compensated on the basis of calculating the attenuation coefficient of the vibration signal at each of the positions, therefore, the sound distortion in the process of bone-conduction may be improved, so that a sound of better quality may be provided to the user at the receiving end. The emission end mentioned herein may be the signal conversion and emission module 2 in the bone-conduction sound transmission device provided by the above embodiments.

In some embodiments, the step of detecting the vibration signal for at least one position in a transmission path from an emission end to a receiving end may comprise detecting the amplitude of the vibration signal for at least one position in the transmission path from the emission end to the receiving end. The step of calculating an attenuation coefficient of the vibration signal at each of the positions may comprise calculating an amplitude attenuation coefficient of the vibration signal at each of the positions. The compensation signal may comprise an amplitude compensation signal, and the step of determining a compensation signal based on the attenuation coefficient may comprise determining the amplitude compensation signal based on the amplitude attenuation coefficient.

In some embodiments, the step of calculating an amplitude attenuation coefficient of the vibration signal at each of the positions may comprise calculating the amplitude attenuation coefficient for the vibration signal at each position according to the following equation (1), $$\alpha_i=(U_0-U_i)/U_0 \tag{1}$$

$\alpha_i$ denotes the amplitude attenuation coefficient of the vibration signal transmitted to the i-th position, and i is a positive integer, the maximum value of which corresponds to the number of the positions. $U_0$ denotes an initial amplitude of the vibration signal emitted from the emission end, and $U_i$ denotes the amplitude of the vibration signal transmitted to the i-th position. The step of determining the amplitude compensation signal based on the amplitude attenuation coefficient may comprise determining the amplitude compensation signal for each position according to the following equation (2), $$B_i=f(\alpha_i) \tag{2}$$

$B_i$ denotes the amplitude compensation signal for the i-th position, $f(\alpha_i)$ may be a piecewise function, so that $B_i$ is in the form of a pulse signal, the value of which is more than one times as large as that of $\alpha_i$.

In this embodiment, by comparing the amplitude $U_i$ for each position with the initial amplitude $U_0$ of the vibration signal, the amplitude attenuation coefficient $\alpha_i$ for each position and thus the amplitude compensation signal $B_i$ for each position may be obtained.

In an embodiment, the number of the positions may be N, among the N positions, a distance between the j-th position and the emission end may be greater than a distance between the (j−1)-th position and the emission end, j is a positive integer, and $1<j\leq N$. The step of calculating an amplitude attenuation coefficient of the vibration signal at each of the positions may comprise calculating the amplitude attenuation coefficient for the vibration signal at each position according to the following equation (3), $$\alpha_j=(U_{j-1}-U_j)/U_{j-1} \tag{3}$$

$\alpha_j$ denotes the amplitude attenuation coefficient of the vibration signal transmitted to the j-th position, $U_j$ denotes the amplitude of the vibration signal transmitted to the j-th position in case of j>1, an initial amplitude of the vibration signal emitted from the emission end is $U_0$ in case of j=1. The step of determining the amplitude compensation signal based on the amplitude attenuation coefficient may comprise determining the amplitude compensation signal for each position according to the following equation (4), $$B_j=f(\alpha_j) \tag{4}$$

$B_j$ denotes the amplitude compensation signal for the j-th position, $f(\alpha_j)$ may be a piecewise function, so that $B_j$ is in the form of a pulse signal, the value of which is more than one times as large as that of $\alpha_j$.

In this embodiment, the amplitude $U_j$ for each position is compared to the amplitude $U_{j-1}$ for the preceding position. In this way, the transmission path will be divided on a smaller, more intimate scale, the length of each sub-transmission path will be shorter, a better compensation effect therefore may be achieved with such embodiment.

In some embodiments, the step of converting the digital audio signal into a vibration signal may comprise performing frequency division for the digital audio signal, such that the digital audio signal is divided into M sub-audio signals having different frequency bands, each sub-audio signal having a center frequency of $f_k$, and M being a positive integer, k being a positive integer in the range of 1 to M; and converting the M sub-audio signals having different frequency bands and the center frequency of $f_k$ into M sub vibration signals, then combining the M sub vibration signals into a complete vibration signal.

For this embodiment of the invention, the digital audio signal may be divided into several sub-audio signals having different frequency bands according to human auditory characteristics, then be processed and transmitted by means of the bone-conduction technology, in this way, the quality of the acoustical signal may be improved.

In some embodiments, the method may further comprise filtering the digital audio signal before performing frequency division for the digital audio signal, so that the noise may be eliminated.

In some embodiments, the method may further comprise, before calculating the attenuation coefficient of the vibration signal at each of the positions, performing frequency division for the detected vibration signal, so that the detected vibration signal is divided into M sub-detected vibration signals having different frequency bands in consistent with those of the divided digital audio signal, each sub-detected vibration signal having the center frequency of $f_k$, M being a positive integer, k being a positive integer in the range of 1 to M. And the method may further comprise, after performing frequency division for the detected vibration signal, calculating the attenuation coefficient for each of the M sub-detected vibration signals having the center frequency of $f_k$, so as to determine M compensation signals based on the calculated M attenuation coefficients, and compensate for the M sub vibration signals with the M compensation signals.

For this embodiment, since the attenuation coefficient for each of the M sub-detected vibration signals may be calculated, and the corresponding M compensation signals may be determined, which then may be provided to the M sub vibration signals for compensation, the accuracy of the compensation may be effectively assured. Generally, the more the different frequency bands are, the higher the precision will be, and the better the effect of the acoustical signal heard by the human will be.

In some embodiments, the method may further comprise filtering the detected vibration signal prior to performing frequency division for the detected vibration signal, so that the noise may be eliminated.

In some embodiments, the step of providing a digital audio signal may comprise receiving an environmental audio signal, and converting the environmental audio signal into the digital audio signal.

Therefore, the embodiment of the invention may enhance the hearing effect of the human's ear for the environmental sound. Method of the embodiment may be used in the headset, and also in the hearing-aid device.

It can be understood that, the above embodiments are just exemplary implementations for explaining the principle of the invention. However, the scope of the invention is not limited to these embodiments. For a person having an ordinary skill in the art, a variety of variations and modifications can be achieved without departing from the spirit and essence of the invention, such variations and modifications should be covered within the scope of the invention.

The invention claimed is:

1. A bone-conduction sound transmission device, comprising, a digital audio signal generator;

a signal converter, for converting the digital audio signal into a vibration signal which is to be transmitted through skeleton and skin;

a signal detector, for detecting the vibration signal for multiple positions in the transmission path from the signal converter to a receiving end, the signal detector comprising a signal amplitude detection unit for detecting each of amplitudes of the vibration signal for the multiple positions; and a signal feedback module which is configured to calculate an amplitude attenuation coefficient of the vibration signal at each of the positions, determine an amplitude compensation signal based on the amplitude attenuation coefficient and compensate for the vibration signal generated from the signal converter with the amplitude compensation signal, wherein the amplitude compensation signal is a function of the amplitude attenuation coefficient.

2. The bone-conduction sound transmission device according to claim 1, wherein the signal converter comprises a vibration generation component for emitting the vibration signal, the signal feedback module applies the compensation signal to the vibration generation component.

3. The bone-conduction sound transmission device according to claim 1, wherein the signal amplitude detection unit comprises at least one signal amplitude detection component corresponding to the position to be detected, which is configured to detect the amplitude of the vibration signal transmitted to the corresponding position.

4. The bone-conduction sound transmission device according to claim 3, wherein the signal feedback module calculates the amplitude attenuation coefficient for the vibration signal at each of the positions according to the following equation (1), $$\alpha_i=(U_0-U_i)/U_0 \quad (1)$$

wherein $\alpha_i$ denotes the amplitude attenuation coefficient of the vibration signal transmitted to the i-th position, and i is a positive integer, the maximum value of which corresponds to the number of the positions;

wherein $U_0$ denotes an initial amplitude of the vibration signal emitted from the signal converter, and $U_i$ denotes the amplitude of the vibration signal transmitted to the i-th position;

wherein the signal feedback module further determines the amplitude compensation signal for each position according to the following equation (2), $$B_i=f(\alpha_i) \quad (2)$$

wherein $B_i$ denotes the amplitude compensation signal for the i-th position, $f(\alpha_i)$ is a piecewise function, so that $B_i$ is in the form of a pulse signal, the value of which is more than one times as large as that of $\alpha_i$.

5. The bone-conduction sound transmission device according to claim 3, wherein the number of the positions is N, each position is provided with a signal amplitude detection component for detecting the amplitude of the vibration signal transmitted to this position.

6. The bone-conduction sound transmission device according to claim 5, wherein among the N positions, a distance between the j-th position and the signal converter is greater than a distance between the (j−1)-th position and the signal converter, wherein j is a positive integer, and $1<j\leq N$, wherein the signal feedback module calculates the amplitude attenuation coefficient for the vibration signal at each position according to the following equation (3), $$\alpha_j=(U_{j-1}-U_j)/U_{j-1} \quad (3)$$

wherein $\alpha_j$ denotes the amplitude attenuation coefficient of the vibration signal transmitted to the j-th position, $U_j$ denotes the amplitude of the vibration signal transmitted to the j-th position, an initial amplitude of the vibration signal emitted from the signal converter is $U_0$ in case of j=1;

wherein the signal feedback module further determines the amplitude compensation signal for each position according to the following equation (4), $$B_j=f(\alpha_j) \quad (4)$$

wherein $B_j$ denotes the amplitude compensation signal for the j-th position, $f(\alpha_j)$ is a piecewise function, so that $B_j$ is in the form of a pulse signal, the value of which is more than one times as large as that of $\alpha_j$.

7. A bone-conduction sound transmission method, comprising the steps of:

providing a digital audio signal;

converting the digital audio signal into a vibration signal which is to be transmitted through skeleton and skin;

detecting the vibration signal for multiple positions in a transmission path from the signal converter to a receiving end;

calculating an amplitude attenuation coefficient of the vibration signal at each of the positions;

determining an amplitude compensation signal based on the amplitude attenuation coefficient, and compensating for the vibration signal with the amplitude compensation signal, wherein the amplitude compensation signal is a function of the amplitude attenuation coefficient.

8. The bone-conduction sound transmission device according to claim 1, wherein the signal converter further comprises:

a first frequency division unit, configured to perform frequency division for the digital audio signal such that the digital audio signal is divided into M sub-audio signals having different frequency bands, each sub-audio signal having a center frequency of $f_k$, and M being a positive integer, k being a positive integer in the range of 1 to M;

a multi-frequency signal conversion unit, configured to convert the M sub-audio signals having different frequency bands and the center frequency of $f_k$ into M sub vibration signals, and a mixing unit for combining the M sub vibration signals into a complete vibration signal.

9. The bone-conduction sound transmission device according to claim 8, wherein the signal converter further comprises a first filtering unit for filtering the digital audio signal, the first frequency division unit is configured to perform frequency division for the filtered digital audio signal.

10. The bone-conduction sound transmission device according to claim 8, wherein the signal feedback module further comprises:

a second frequency division unit, which is configured to perform frequency division for the vibration signal detected by the signal detector, so that the detected vibration signal is divided into M sub-detected vibration signals having different frequency bands in consistent with those of the divided digital audio signals, each sub-detected vibration signal having the center frequency of $f_k$, M being a positive integer, k being a positive integer in the range of 1 to M;

and a multiple-frequency signal feedback unit, which is configured to calculate the amplitude attenuation coefficient for each of the M sub-detected vibration signals having the center frequency of $f_k$, determine M compensation signals based on the calculated M amplitude attenuation coefficients, and compensate for the M sub vibration signals generated by the multi-frequency signal conversion unit with the M compensation signals.

11. The bone-conduction sound transmission device according to claim 10, wherein the signal feedback module further comprises a second filtering unit for filtering the vibration signal detected by the signal detector, and the second frequency division unit is configured to perform frequency division for the filtered vibration signal.

12. The bone-conduction sound transmission device according to claim 1, wherein the digital audio signal generator comprises an environmental audio receiving unit for receiving an environmental audio signal and converting the environmental audio signal into the digital audio signal.

13. The bone-conduction sound transmission method according to claim 7, wherein the number of the positions is N, among the N positions, a distance between the j-th position and the emission end is greater than a distance between the (j−1)-th position and the emission end , wherein j is a positive integer, and $1<j\leq N$, wherein the step of calculating an amplitude attenuation coefficient of the vibration signal at each of the positions comprises calculating the amplitude attenuation coefficient for the vibration signal at each position according to the following equation (3), $$\alpha_j=(U_{j-1})/U_{j-1} \quad (3)$$

wherein $\alpha_j$ denotes the amplitude attenuation coefficient of the vibration signal transmitted to the j-th position, $U_j$, denotes the amplitude of the vibration signal transmitted to the j-th position in case of j>1, an initial amplitude of the vibration signal emitted from the emission end is $U_0$ in case of j=1;

wherein the step of determining the amplitude compensation signal based on the amplitude attenuation coefficient comprises determining the amplitude compensation signal for each position according to the following equation (4), $$B_j=f(\alpha_j) \quad (4)$$

wherein $B_j$ denotes the amplitude compensation signal for the j-th position, f ($\alpha_j$) is a piecewise function, so that $B_j$ is in the form of a pulse signal, the value of which is more than one times as large as that of $\alpha_j$.

14. The bone-conduction sound transmission method according to claim 7, wherein the step of calculating an amplitude attenuation coefficient of the vibration signal at each of the positions comprises:

calculating the amplitude attenuation coefficient for the vibration signal at each position according to the following equation (1), $$\alpha_i=(U_0-U_i)/U_0 \quad (1)$$

wherein $\alpha_i$ denotes the amplitude attenuation coefficient of the vibration signal transmitted to the i-th position, and i is a positive integer, the maximum value of which corresponds to the number of the positions, wherein $U_0$ denotes an initial amplitude of the vibration signal emitted from the emission end, and $U_i$ denotes the amplitude of the vibration signal transmitted to the i-th position;

wherein the step of determining the amplitude compensation signal based on the amplitude attenuation coefficient comprises determining the amplitude compensation signal for each position according to the following equation (2), $$B_i=f(\alpha_i) \quad (2)$$

wherein $B_i$ denotes the amplitude compensation signal for the i-th position, f ($\alpha_i$) is a piecewise function, so that $B_i$ is in the form of a pulse signal, the value of which is more than one times as large as that of $\alpha_i$.

15. The bone-conduction sound transmission method according to claim 14, wherein the step of converting the digital audio signal into a vibration signal comprises:

performing frequency division for the digital audio signal, such that the digital audio signal is divided into M sub-audio signals having different frequency bands, each sub-audio signal having a center frequency of $f_k$, and M being a positive integer, k being a positive integer in the range of 1 to M;

converting the M sub-audio signals having different frequency bands and the center frequency of $f_k$ into M sub vibration signals, and combining the M sub vibration signals into a complete vibration signal.

16. The bone-conduction sound transmission method according to claim 15, wherein the method further comprises filtering the digital audio signal before performing frequency division for the digital audio signal.

17. The bone-conduction sound transmission method according to claim 15, wherein the method further comprises:

before calculating the amplitude attenuation coefficient of the vibration signal at each of the positions, performing frequency division for the detected vibration signal, so that the detected vibration signal is divided into M sub-detected vibration signals having different frequency bands in consistent with those of the divided digital audio signal, each sub-detected vibration signal having the center frequency of $f_k$, M being a positive integer, k being a positive integer in the range of 1 to M;

wherein the method further comprises:

after performing frequency division for the detected vibration signal, calculating the amplitude attenuation coefficient for each of the M sub-detected vibration signals having the center frequency of $f_k$, so as to determine M compensation signals based on the calculated M amplitude attenuation coefficients, and compensate for the M sub vibration signals with the M compensation signals.

18. The bone-conduction sound transmission method according to claim 17, wherein the method further comprises:

filtering the detected vibration signal prior to performing frequency division for the detected vibration signal.

* * * * *